US006490893B1

(12) United States Patent
Benion

(10) Patent No.: US 6,490,893 B1
(45) Date of Patent: Dec. 10, 2002

(54) PORTABLE LOCKBOX

(76) Inventor: Jessie K. Benion, 964 Jim Locke Rd., Carrollton, AL (US) 35447

( * ) Notice: Subject to any disclaimer, the term of this patent is extended or adjusted under 35 U.S.C. 154(b) by 41 days.

(21) Appl. No.: 09/636,614

(22) Filed: Aug. 11, 2000

(51) Int. Cl.[7] ..... B65D 55/14

(52) U.S. Cl. ..... 70/63; 109/45; 109/58.5; 206/1.5; 206/37.1; 232/1 D; 232/43.1

(58) Field of Search ..... 70/63, 456 R; 109/29, 33, 37, 45, 50, 58, 58.5; 232/1 D, 43.1, 43.4, 43.5; 206/37, 37.1, 39, 1.5; 220/210, 315, 751, 752, 759, 769

(56) References Cited

U.S. PATENT DOCUMENTS

| | | | | | |
|---|---|---|---|---|---|
| 99,736 | A | * | 2/1870 | Wiler | |
| 354,459 | A | * | 12/1886 | Brooks | |
| 453,879 | A | * | 6/1891 | Burns | |
| 901,409 | A | * | 10/1908 | Woolums | |
| 928,483 | A | * | 7/1909 | Wakeman | |
| 2,101,877 | A | * | 8/1937 | Morell | 232/1 |
| 2,438,785 | A | * | 3/1948 | McKallick | 232/34 |
| 3,589,505 | A | * | 6/1971 | Burniski | 206/1.5 X |
| 3,688,708 | A | | 9/1972 | Meyerhoefer | |
| 3,738,134 | A | | 6/1973 | Hall | |
| 3,927,442 | A | * | 12/1975 | Foster | 24/163 K |
| 4,051,790 | A | * | 10/1977 | Meditz et al. | 109/58 |
| 4,174,034 | A | * | 11/1979 | Hoo | 206/1.5 |
| 4,202,445 | A | | 5/1980 | Porter | |
| D265,125 | S | * | 6/1982 | Jordan | 232/43.1 X |
| 4,493,433 | A | * | 1/1985 | Sideri et al. | 206/1.5 X |
| 4,548,353 | A | | 10/1985 | Howard et al. | |
| D281,920 | S | | 12/1985 | Lacka | |
| 4,573,332 | A | | 3/1986 | Ma | |
| 4,649,723 | A | * | 3/1987 | Appelbaum | 70/63 |
| 4,718,259 | A | * | 1/1988 | Appelbaum | 70/63 |
| 4,853,676 | A | * | 8/1989 | Kitts | 109/33 X |
| 5,143,284 | A | * | 9/1992 | Socarras | 232/43.1 X |
| 5,596,821 | A | * | 1/1997 | Solo | 206/37.1 X |
| 5,598,926 | A | * | 2/1997 | Vogt | 206/37 X |
| 5,890,439 | A | * | 4/1999 | McGunn | 232/1 D |
| 5,918,554 | A | * | 7/1999 | Rassamni | 109/29 |
| 6,113,268 | A | * | 9/2000 | Thompson | 109/50 X |

* cited by examiner

*Primary Examiner*—Suzanne Dino Barrett

(57) ABSTRACT

A portable lock-box for storing and safekeeping valuables including money and credit cards. The portable lock-box includes a hand-held container having a front wall, a back wall, side walls, and end walls with one of the end walls having a slot disposed therethrough and with an opening being disposed through the back wall for accessing any contents in the hand-held container; and also includes a cover removably and lockingly disposed over the opening for securing the contents contained in the hand-held container; and further includes a door assembly including a door member being biasedly and hingedly closed over the slot; and also includes a carrying assembly for carrying the hand-held container; and further includes a lock assembly for locking the cover over the opening in the back wall.

17 Claims, 4 Drawing Sheets

PORTABLE LOCKBOX

BACKGROUND OF THE INVENTION

1. Field of the Invention

The present invention relates to a secured hand-held box and more particularly pertains to a new portable lock-box for storing and safekeeping valuables including money and credit cards.

2. Description of the Prior Art

The use of a secured hand-held box is known in the prior art. More specifically, a secured hand-held box heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,202,445; 4,573,332; 3,688,708; 4,548,353; 3,738,134; and U.S. Pat. No. Des. 281,920.

While these devices fulfill their respective, particular objectives and requirements, the aforementioned patents do not disclose a new portable lock-box. The inventive device includes a hand-held container having a front wall, a back wall, side walls, and end walls with one of the end walls having a slot disposed therethrough and with an opening being disposed through the back wall for accessing any contents in the hand-held container; and also includes a cover removably and lockingly disposed over the opening for securing the contents contained in the hand-held container; and further includes a door assembly including a door member being biasedly and hingedly closed over the slot; and also includes a carrying assembly for carrying the hand-held container; and further includes a lock assembly for locking the cover over the opening in the back wall.

In these respects, the portable lock-box according to the present invention substantially departs from the conventional concepts and designs of the prior art, and in so doing provides an apparatus primarily developed for the purpose of storing and safekeeping valuables including money and credit cards.

SUMMARY OF THE INVENTION

In view of the foregoing disadvantages inherent in the known types of secured hand-held box now present in the prior art, the present invention provides a new portable lock-box construction wherein the same can be utilized for storing and safekeeping valuables including money and credit cards.

The general purpose of the present invention, which will be described subsequently in greater detail, is to provide a new portable lock-box which has many of the advantages of the secured hand-held box mentioned heretofore and many novel features that result in anew portable lock-box which is not anticipated, rendered obvious, suggested, or even implied by any of the prior art secured hand-held box, either alone or in any combination thereof.

To attain this, the present invention generally comprises a hand-held container having a front wall, a back wall, side walls, and end walls with one of the endwalls having a slot disposed therethrough and with an opening being disposed through the back wall for accessing any contents in the hand-held container; and also includes a cover removably and lockingly disposed over the opening for securing the contents contained in the hand-held container; and further includes a door assembly including a door member being biasedly and hingedly closed over the slot; and also includes a carrying assembly for carrying the hand-held container; and further includes a lock assembly for locking the cover over the opening in the back wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable lock-box which has many of the advantages of the secured hand-held box mentioned heretofore and many novel features that result in a new portable lock-box which is not anticipated, rendered obvious, suggested, or even implied by any of the prior art secured hand-held box, either alone or in any combination thereof.

It is another object of the present invention to provide a new portable lock-box which maybe easily and efficiently manufactured and marketed.

It is a further object of the present invention to provide a new portable lock-box which is of a durable and reliable construction.

An even further object of the present invention is to provide a new portable lock-box which is susceptible of a low cost of manufacture with regard to both materials and labor, and which accordingly is then susceptible of low prices of sale to the consuming public, thereby making such portable lock-box economically available to the buying public.

Still yet another object of the present invention is to provide a new portable lock-box which provides in the apparatuses and methods of the prior art some of the advantages thereof, while simultaneously overcoming some of the disadvantages normally associated therewith.

Still another object of the present invention is to provide a new portable lock-box for storing and safekeeping valuables including money and credit cards.

Yet another object of the present invention is to provide a new portable lock-box which includes a hand-held container having a front wall, a back wall, side walls, and end walls with one of the end walls having a slot disposed therethrough and with an opening being disposed through the back wall for accessing any contents in the hand-held container; and also includes a cover removably and lockingly disposed over the opening for securing the contents contained in the hand-held container; and further includes a door assembly including a door member being biasedly and hingedly closed over the slot; and also includes a carrying assembly for carrying the hand-held container; and further includes a lock assembly for locking the cover over the opening in the back wall.

Still yet another object of the present invention is to provide a new portable lock-box that effectively safeguards one's valuables.

Even still another object of the present invention is to provide a new portable lock-box that lets the user always know where one's valuables are.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
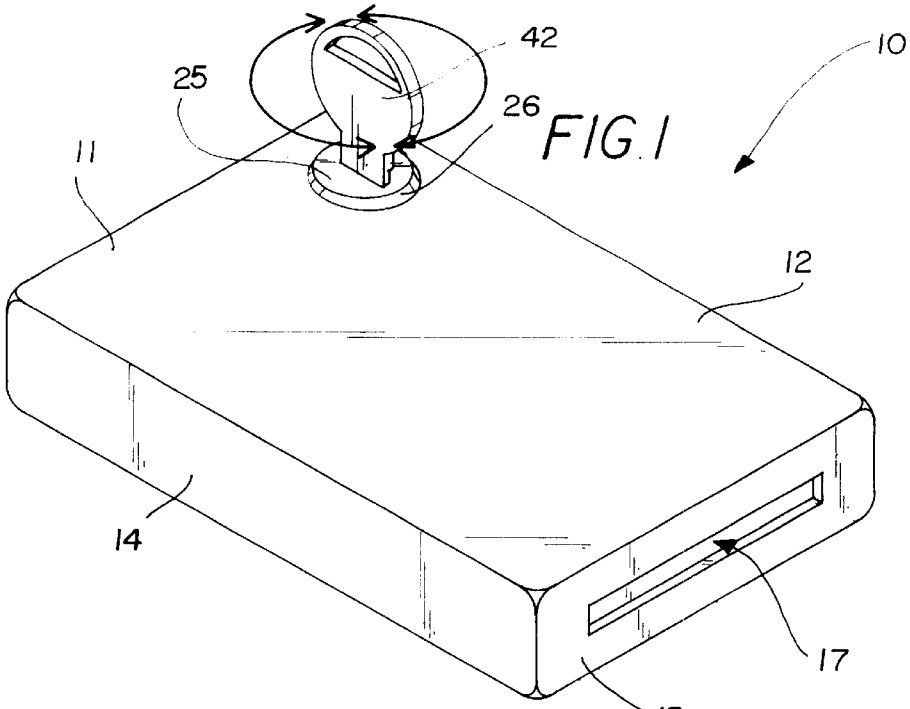
FIG. 1 is a top perspective view of a new portable lock-box according to the present invention.
Figure 2:
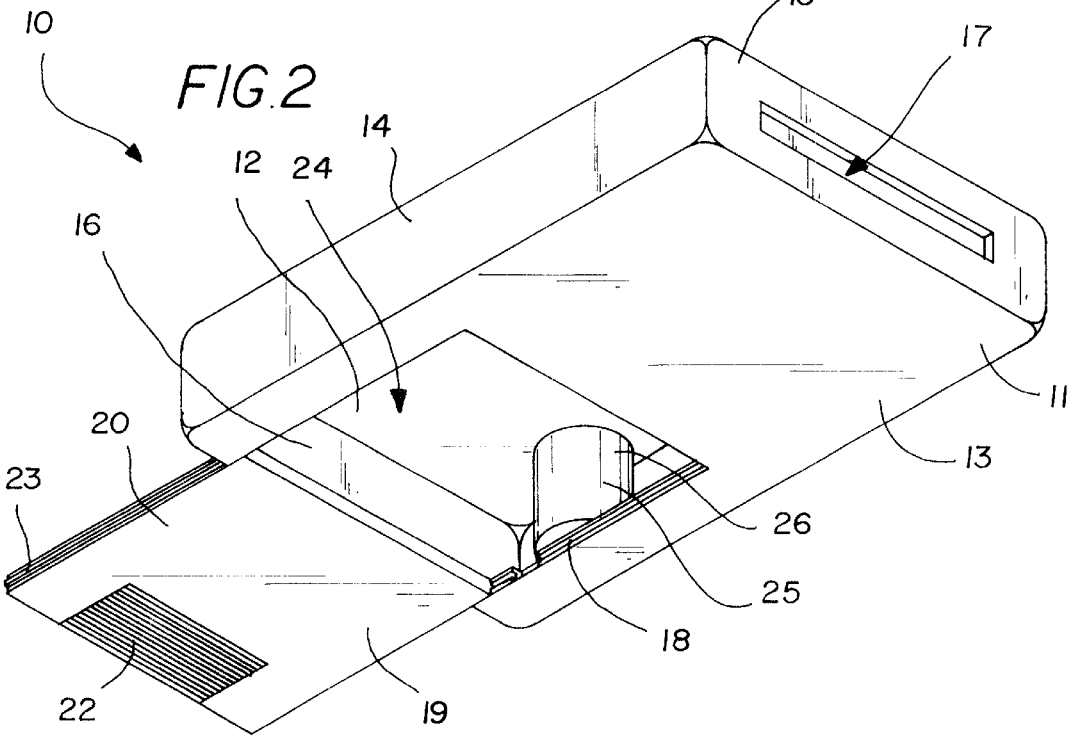
FIG. 2 is a bottom perspective view of the present invention.
Figure 3:
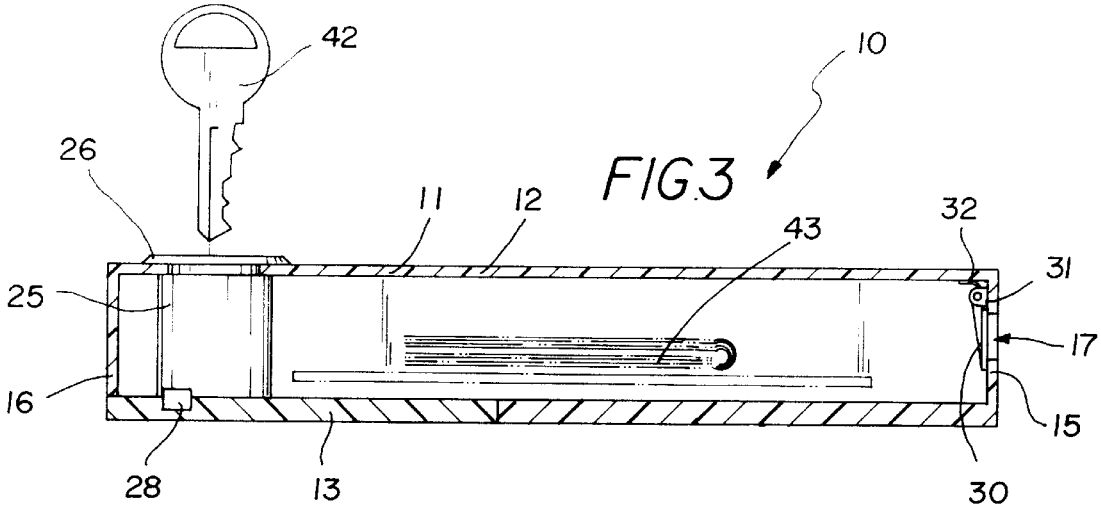
FIG. 3 is a cross-sectional view of the present invention.
Figure 4:
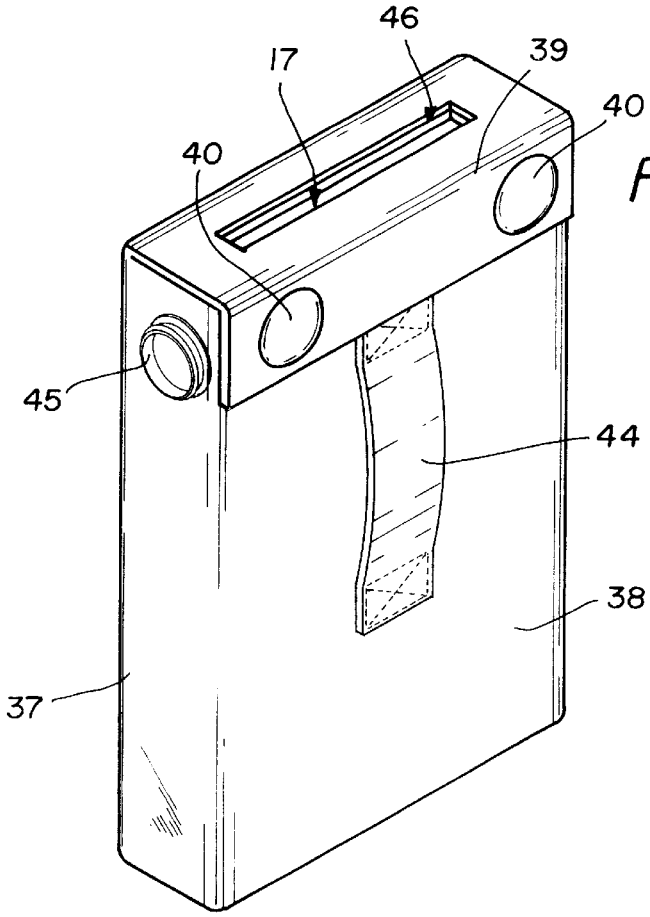
FIG. 4 is a perspective view of the present invention including the carrying case.
Figure 5:
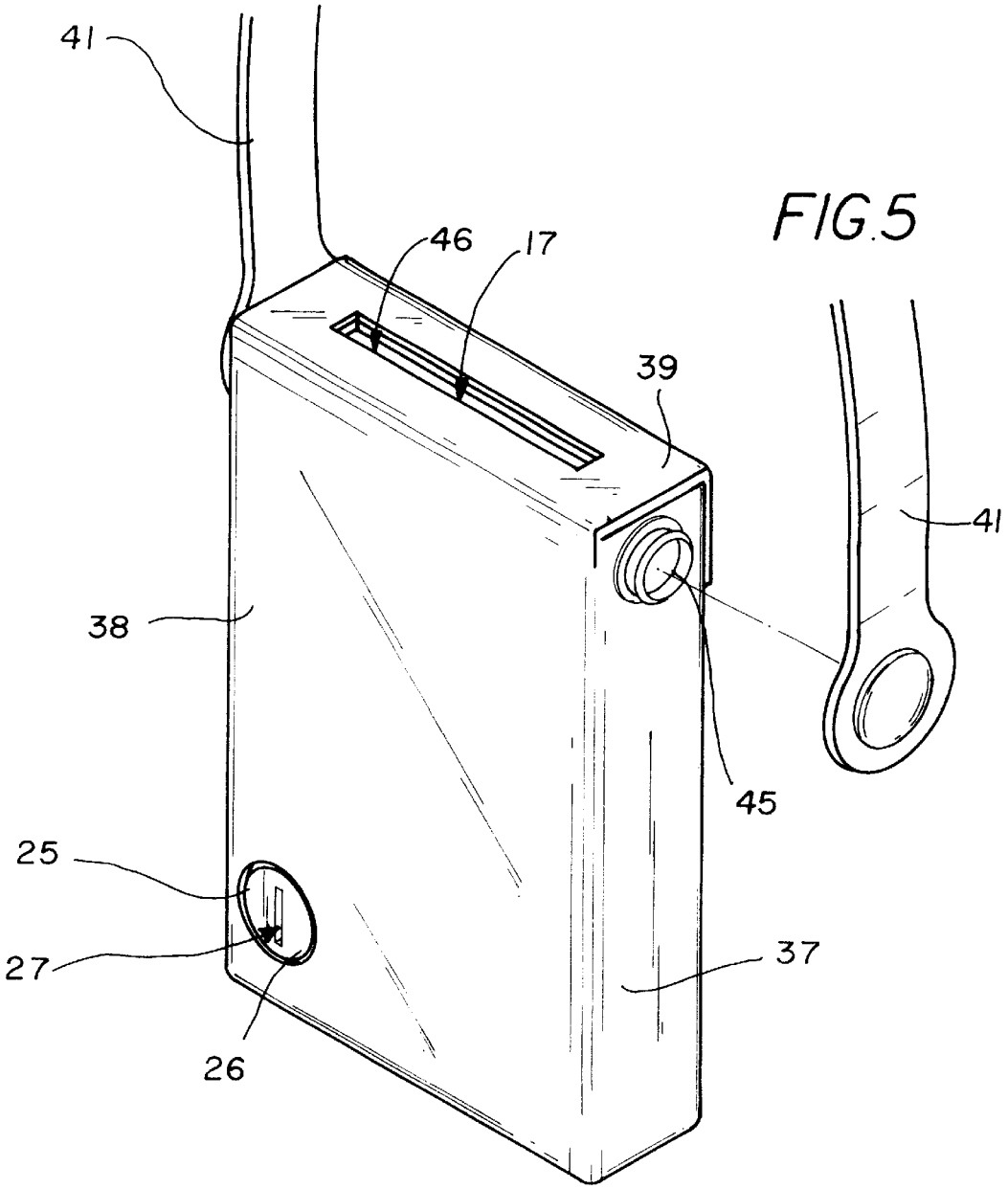
FIG. 5 is a perspective view of the present invention showing the carrying case with the loop member and the strap.
Figure 6:
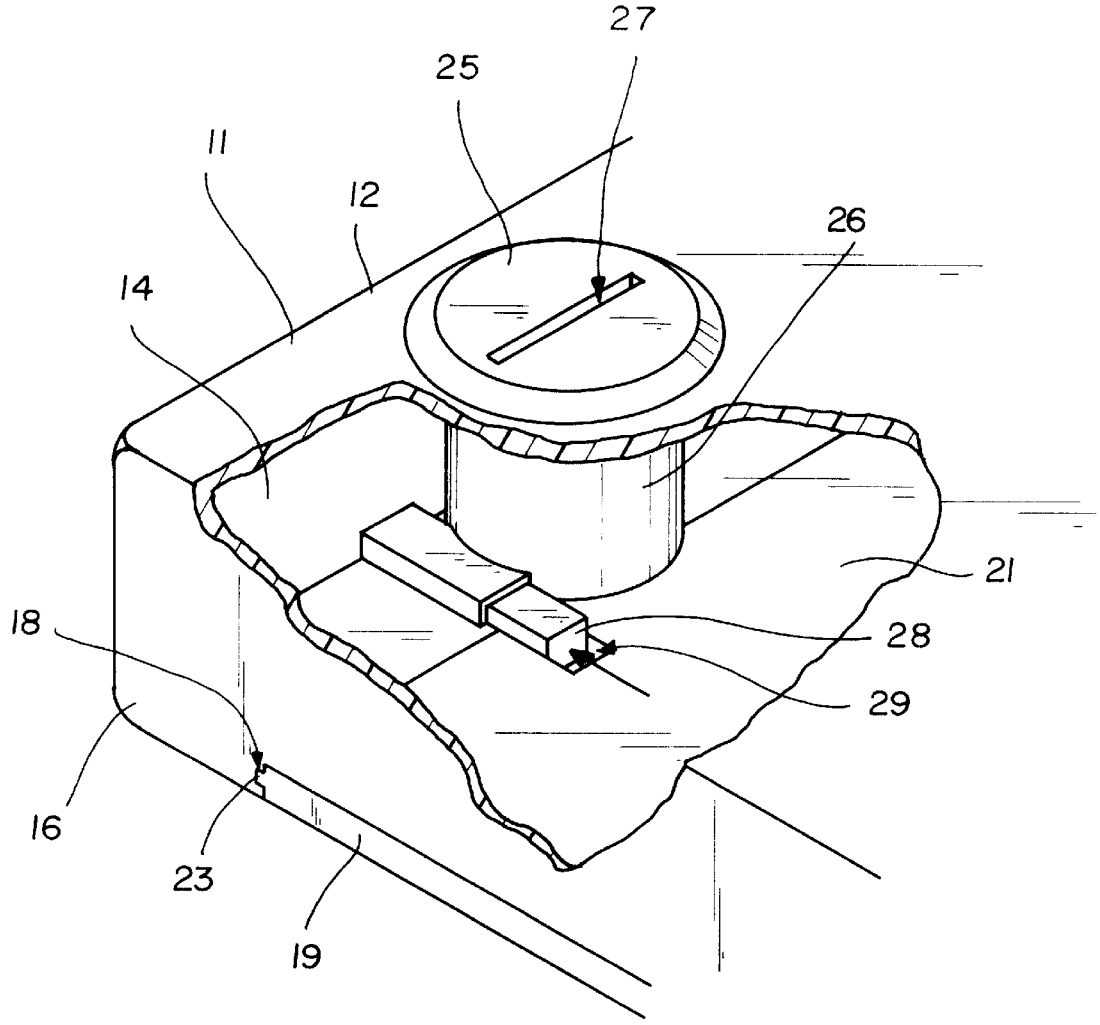
FIG. 6 is a partial cutaway perspective view of the present invention showing the lock assembly.

With reference now to the drawings, and in particular to FIGS. 1 through 6 thereof, a new portable lock-box embodying the principles and concepts of the present invention and generally designated by the reference numeral 10 will be described.

As best illustrated in FIGS. 1 through 6, the portable lock-box 10 generally comprises a hand-held container 11 having a front wall 12, a back wall 13, side walls 14, and end walls 15,16 with a first 15 of the end walls having a slot 17 disposed therethrough and with an opening 24 being disposed through the back wall 13 for accessing any contents 43 in the hand-held container 11. The hand-held container 11 is adapted to store items 43 including paper money and credit cards with the slot 17 being adapted to receive the items 43 therethrough into the hand-held container 11. The hand-held container 11 includes channels 18 extending in and along edges forming the opening 24 in the back wall 13 thereof with the hand-held container 11 being approximately 5 inches long, 3 inches wide and ¾ inch thick and with the slot 17 being approximately 2½ inches long and ¼ inch wide.

A cover 19 is removably and lockingly disposed over the opening 24 for securing the contents 43 contained in the hand-held container 11. The cover 19 includes longitudinal flanges 23 conventionally extending from side edges thereof and being adapted to be movably and retentionably received in the channels 18 of the back wall 13 of the hand-held container 11. The cover 19 includes a first side 20 having a plurality of ridges 22 disposed thereupon for allowing a user to grasp with one's finger to move the cover 19 to open the hand-held container 11. The cover 19 also includes a second side 21 having a groove 29 extending inwardly from one of the edges thereof.

A door assembly includes a door member 30 being biasedly and hingedly closed over the slot 17 with the door assembly including bracket members 31 securely and conventionally attached to an interior of the first end wall 15 adjacent to the slot 17, and also including the door member 20 being hingedly attached to the bracket members 31, and further including a leaf spring 32 being mounted to the bracket members 31 and being engageable to the door member 30 for biasedly closing the door member 30 over the slot 17.

A carrying assembly for carrying the hand-held, container 11 includes a carrying case 37 having a main portion 38 being adapted to removably receive the hand-held container 11 and also having a flap portion 39 and flap fastening members 40 securely and conventionally disposed upon the flap portion 39 for fastening the flap portion 39 to the main portion 38 to enclose the hand-held container 11 therein, and further including strap fastening members 45 securely attached to sides of the main portion 38, and also including an adjustable strap 41 having ends which are removably fastened to the strap fastening members 45 for allowing a user to carry the portable lock-box 10 about one's shoulder and further including a loop member 44 having ends securely and conventionally attached to an exterior of the main portion 38 and being adapted to allow a user to pass one's belt therethrough for carrying the hand-held container 11 on the user's belt, and also including a slot 46 disposed through the flap portion 39 and being dimensioned generally equivalent to the slot 17 in the hand-held container 11 so that the contents 43 can be inserted through both slots 17,46 and into the hand-held container 11.

A lock assembly for locking the cover 19 over the opening 24 in the back wall 13 includes a lock mechanism 25 having a housing 26 and a keyhole 27 disposed in one end thereof and also being securely and conventionally disposed in the hand-held container 11 near a second 16 of the end walls thereof, and also includes a locking member 28 being conventionally connected to the lock mechanism 25 and being movably disposed upon an interior of the back wall 13 of the hand-held container 11 and being retractably received in the groove 29 in the second side 21 of the cover 19 for securely locking the cover 19 to the hand-held container 11, and further includes a key member 42 for locking and unlocking the lock mechanism 25 with the locking member 28 being essentially a sliding bolt.

In use, the user inserts money 43 such as paper money and credit cards into the hand-held container 11 through the slots 17,46 for storing and safekeeping especially while playing at a casino. When the user wants to remove the money and credit cards from the hand-held container 11, the user uses the key member 42 to unlock the lock mechanism 25 to allow the user to slide the cover 19 to open the hand-held container 11.

As to a further discussion of the manner of usage and operation of the present invention, the same should be apparent from the above description. Accordingly, no further discussion, relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable lock-box comprising:

a hand-held container having a front wall, a back wall side walls, and end walls with a first of said end walls having a slot disposed therethrough and with an opening being disposed through said back wall for accessing any contents in said hand-held container, said hand-held container being adapted to store items including paper money and credit cards, said slot being adapted to receive the items therethrough into said hand-held container, dimensions of said hand-held container being configured such that said hand-held container is supportable on a belt on pants of a user;

a cover removably and lockingly disposed over said opening for securing the contents contained in said hand-held container;

a door assembly including a door member being biasedly and hingedly closed over said slot;

a carrying assembly for carrying said hand-held container;

a lock assembly for locking said cover over said opening in said back wall; and wherein said slot of said container is positioned on an end wall of said container such that said slot is accessible to the user when said container is positioned in the pocket of clothing of the user or when said container is positioned in said carrying assembly while positioned on the user;

wherein said carrying assembly includes a carrying case having a main portion being adapted to removably receive said hand-held container, and also having a flap portion and flap fastening members securely disposed upon said flap portion for fastening said flap portion to said main portion, said flap portion including a slot disposed therethrough and being dimensioned substantially coextensive with said slot in said hand-held container so that the contents are insertable into said hand-held container while fully received by said carrying assembly, and further includes strap fastening members securely attached to sides of said main portion, and also includes an adjustable strap having ends being removably fastenable to said strap fastening members for allowing a user to carry said portable lock-box about one's shoulder, and further includes a loop member having ends securely attached to an exterior of said main portion and being adapted to allow a user to pass one's belt therethrough for allowing the user to carry said hand-held container on the user's belt.

2. A portable lock-box as described in claim 1, wherein said hand-held container includes channels extending in and along edges forming said opening in said back wall thereof.

3. A portable lock-box as described in claim 2, wherein said cover includes longitudinal flanges extending from side edges thereof and being adapted to be movably and retentionably received in said channels of said back wall of said hand-held container.

4. A portable lock-box as described in claim 1, wherein said cover includes a first side having a plurality of ridges disposed thereupon for allowing a user to grasp with one's finger to move said cover to open said hand-held container.

5. A portable lock-box as described in claim 3, wherein said cover includes a second side having a groove extending inwardly from one of said edges thereof.

6. A portable lock-box as described in claim 1, wherein said door assembly includes bracket members securely attached to an interior of said first end wall adjacent to said slot, and also includes a door member being hingedly attached to said bracket members, and further includes a leaf spring being mounted to said bracket members and being engageable to said door member for biasedly closing said door member over said slot.

7. A portable lock-box as described in claim 5, wherein said lock assembly includes a lock mechanism having a housing and a keyhole disposed in one end thereof and also being securely disposed in said hand-held container near a second of said end walls thereof, and also includes a locking member being connected to said lock mechanism and being movably disposed upon an interior of said back wall of said hand-held container and being retractably received in said groove in a second side of said cover for securely locking said cover to said hand-held container, and further includes a key member for locking and unlocking said lock mechanism.

8. A portable lock-box as described in claim 7, wherein said locking member is essentially a sliding bolt.

9. A portable lock-box comprising:

a hand-held container having a front wall, a back wall, side walls, and end walls with a first of said end walls having a slot disposed therethrough and with an opening being disposed through said back wall for accessing any contents in said hand-held container, said hand-held container being adapted to store items including paper money and credit cards, said slot being adapted to receive the items therethrough into said hand-held container, said hand-held container including channels extending in and along edges forming said opening in said back wall thereof, said hand-held container being approximately 5 inches long, 3 inches wide and ¾ inch thick, said slot being approximately 2½ inches long and ¼ inch wide;

a cover removably and lockingly disposed over said opening for securing the contents contained in said hand-held container, said cover including longitudinal flanges extending from side edges thereof and being adapted to be movably and retentionably received in said channels of said back wall of said hand-held container, said cover including a first side having a plurality of ridges disposed thereupon for allowing a user to grasp with one's finger to move said cover to open said hand-held container, said cover including a second side having a groove extending inwardly from one of said edges thereof;

a door assembly including a door member being biasedly and hingedly closed over said slot, said door assembly including bracket members securely attached to an interior of said first end wall adjacent to said slot, and also including a door member being hingedly attached to said bracket members, and further including a leaf spring being mounted to said bracket members and being engageable to said door member for biasedly closing said door member over said slot;

a carrying assembly for carrying said hand-held container, said carrying assembly including a carrying case having a main portion being adapted to removably receive said hand-held container, and also having a flap portion and flap fastening members securely disposed upon said flap portion for fastening said flap portion to said main portion, and further including strap fastening members securely attached to sides of said main portion, and also including an adjustable strap having ends which is removably fastened to said strap fastening members for allowing a user to carry said portable lock-box about one's shoulder, and also including a loop member having ends securely attached to an exterior of said main portion and being adapted to allow a user to pass one's belt therethrough for allowing the user to carry said hand-held container on one's belt; and a lock assembly for locking said cover over said opening in said back wall, said lock assembly including a lock mechanism having a housing and a keyhole disposed in one end thereof and also being securely disposed in said hand-held container near a second of said end walls thereof, and also including a locking member being connected to said lock mechanism and being movably disposed upon an interior of said back wall of said hand-held container and being retractably received in said groove in a second side of said cover for securely locking said cover to said hand-held container, and further including a key member for locking and unlocking said lock mechanism, said locking member being essentially a sliding bolt.

10. A portable lock-box comprising:

a hand-held container having a front wall, a back wall, side walls, and end walls with a first of said end walls having a slot disposed therethrough and with an opening being disposed through said back wall for accessing any contents in said hand-held container, said hand-held container being adapted to store items including paper money and credit cards, said slot being adapted to receive the items therethrough into said hand-held container, dimensions of said hand-held container being configured such that said hand-held container is supportable on a belt on pants of a user;

a cover removably and lockingly disposed over said opening for securing the contents contained in said hand-held container;

a door assembly including a door member being biasedly and hingedly closed over said slot;

a carrying assembly for carrying said hand-held container;

a lock assembly for locking said cover over said opening in said back wall; and wherein said slot of said container is positioned on an end wall of said container such that said slot is accessible to the user when said container is positioned in the pocket of clothing of the user or when said container is positioned in said carrying assembly while positioned on the user;

wherein said hand-held container being approximately 5 inches long, 3 inches wide and ¾ inch thick, said slot being approximately 2½ inches long and ¼ inch wide.

11. A portable lock-box as described in claim 10, wherein said hand-held container includes channels extending in and along edges forming said opening in said back wall thereof.

12. A portable lock-box as described in claim 11, wherein said cover includes longitudinal flanges extending from side edges thereof and being adapted to be movably and retentionably received in said channels of said back wall of said hand-held container.

13. A portable lock-box as described in claim 10, wherein said cover includes a first side having a plurality of ridges disposed thereupon for allowing a user to grasp with one's finger to move said cover to open said hand-held container.

14. A portable lock-box as described in claim 12, wherein said cover includes a second side having a groove extending inwardly from one of said edges thereof.

15. A portable lock-box as described in claim 10, wherein said door assembly includes bracket members securely attached to an interior of said first end wall adjacent to said slot, and also includes a door member being hingedly attached to said bracket members, and further includes a leaf spring being mounted to said bracket members and being engageable to said door member for biasedly closing said door member over said slot.

16. A portable lock-box as described in claim 14, wherein said lock assembly includes a lock mechanism having a housing and a keyhole disposed in one end thereof and also being securely disposed in said hand-held container near a second of said end walls thereof, and also includes a locking member being connected to said lock mechanism and being movably disposed upon an interior of said back wall of said hand-held container and being retractably received in said groove in a second side of said cover for securely locking said cover to said hand-held container and further includes a key member for locking and unlocking said lock mechanism.

17. A portable lock-box as described in claim 16, wherein said locking member is essentially a sliding bolt.

* * * * *